US006743115B2

(12) United States Patent
Rodarte

(10) Patent No.: US 6,743,115 B2
(45) Date of Patent: Jun. 1, 2004

(54) GOLF CLUB AND GOLF CLUB GRIP ASSEMBLY

(76) Inventor: Michael R. Rodarte, 12371 Nutwood, Garden Grove, CA (US) 92640

( * ) Notice: Subject to any disclaimer, the term of this patent is extended or adjusted under 35 U.S.C. 154(b) by 0 days.

(21) Appl. No.: 10/077,159

(22) Filed: Feb. 15, 2002

(65) Prior Publication Data

US 2003/0157992 A1 Aug. 21, 2003

(51) Int. Cl.[7] ..... A63B 53/14
(52) U.S. Cl. ..... 473/294; 473/298; 473/300
(58) Field of Search ..... 473/201–204, 473/206, 212, 213, 214, 300, 303, 294, 296, 298, 299, 316–318, 322, 301–302; D21/756–759

(56) References Cited

U.S. PATENT DOCUMENTS 3,574,349 A * 4/1971 Kropp ..... 473/293
4,880,240 A * 11/1989 Lewis
5,556,345 A * 9/1996 Whitesell
5,792,007 A * 8/1998 Billings
5,795,241 A * 8/1998 Peshek
6,022,278 A * 2/2000 Vela ..... 473/201
6,110,054 A * 8/2000 Rodarte
6,123,625 A * 9/2000 Koblentz
2002/0025860 A1 * 2/2002 Sosin

* cited by examiner

*Primary Examiner*—Stephen Blau
(74) *Attorney, Agent, or Firm*—Richard E. Bee

(57) ABSTRACT

A golf club having a novel golf club grip assembly is described. The grip assembly includes an elongated forearm stabilizer blade mounted directly on the upper end of the golf club shaft and extending upwardly in line with the golf club shaft. A connector rod formed integrally with the stabilizer blade extends from the golf club shaft end of the stabilizer blade and is inserted into the upper end of the golf club shaft. In use, the stabilizer blade is pressed against the inside of the forearm of the golf player to provide a steady and accurate pendulum effect when swinging the club to hit a golf ball. In a second embodiment, the stabilizer blade is fabricated separately and is slipped over an elongated rod having an exposed end which is inserted into the upper end of the golf club shaft.

11 Claims, 3 Drawing Sheets

30
31
16
32
33
T
W
4
5
16A
34
15

GOLF CLUB AND GOLF CLUB GRIP ASSEMBLY

BACKGROUND OF THE INVENTION

This invention relates to golf clubs and to grip assemblies for golf clubs.

In my earlier U.S. Pat. No. 6,110,054, there is described a golf club grip assembly for stabilizing and improving the swinging of a golf club. The grip assembly described therein includes a pistol grip body adapted to be fixed to the upper end of a golf club shaft for gripping by the dominant hand of a golf player. Such grip assembly also includes a forearm stabilizer blade affixed to the upper end of the pistol grip body and extending upwardly for engaging the dominant forearm of a golf player gripping the pistol grip body.

The grip assembly described in my earlier patent has been found to provide the desired results. It has been found to greatly improve the swinging of a golf club and to improve the accuracy and consistency of the shots made with the golf club.

Unfortunately, the grip assembly of my earlier patent appears to have a significant limitation. It does not appear to fully conform with the Rules and Regulations of the United States Golf Association concerning the design of golf clubs used in tournament play. Because of this, there is a good possibility that its use would not be allowed in major golf tournaments. It would be desirable, therefore, to provide a new and improved golf club which incorporates the improved swinging characteristics described in my earlier patent while, at the same time, being in full compliance with the Rules and Regulations of the United States Golf Association.

SUMMARY OF THE INVENTION

In accordance with one feature of the invention, there is provided a golf club comprising a club head for striking a golf ball, a golf club shaft attached to the club head and extending upwardly therefrom and a forearm stabilizer blade attached directly to the upper end of the golf club shaft and extending upwardly in line with the golf club shaft.

In accordance with another feature of the invention, there is provided a golf club grip assembly comprising an elongated forearm stabilizer blade for mounting directly on an upper end of a golf club shaft in line with the golf club shaft and a connector rod formed integrally with the stabilizer blade and extending from the golf club shaft end of the stabilizer blade for insertion into the upper end of the golf club shaft.

For a better understanding of the present invention, together with other and further advantages and features thereof, reference is made to the following description taken in connection with the accompanying drawings, the scope of the invention being pointed out in the appended claims.

BRIEF DESCRIPTION OF THE DRAWINGS

Referring to the drawings.

DETAILED DESCRIPTION OF THE ILLUSTRATED EMBODIMENTS

Figure 1:
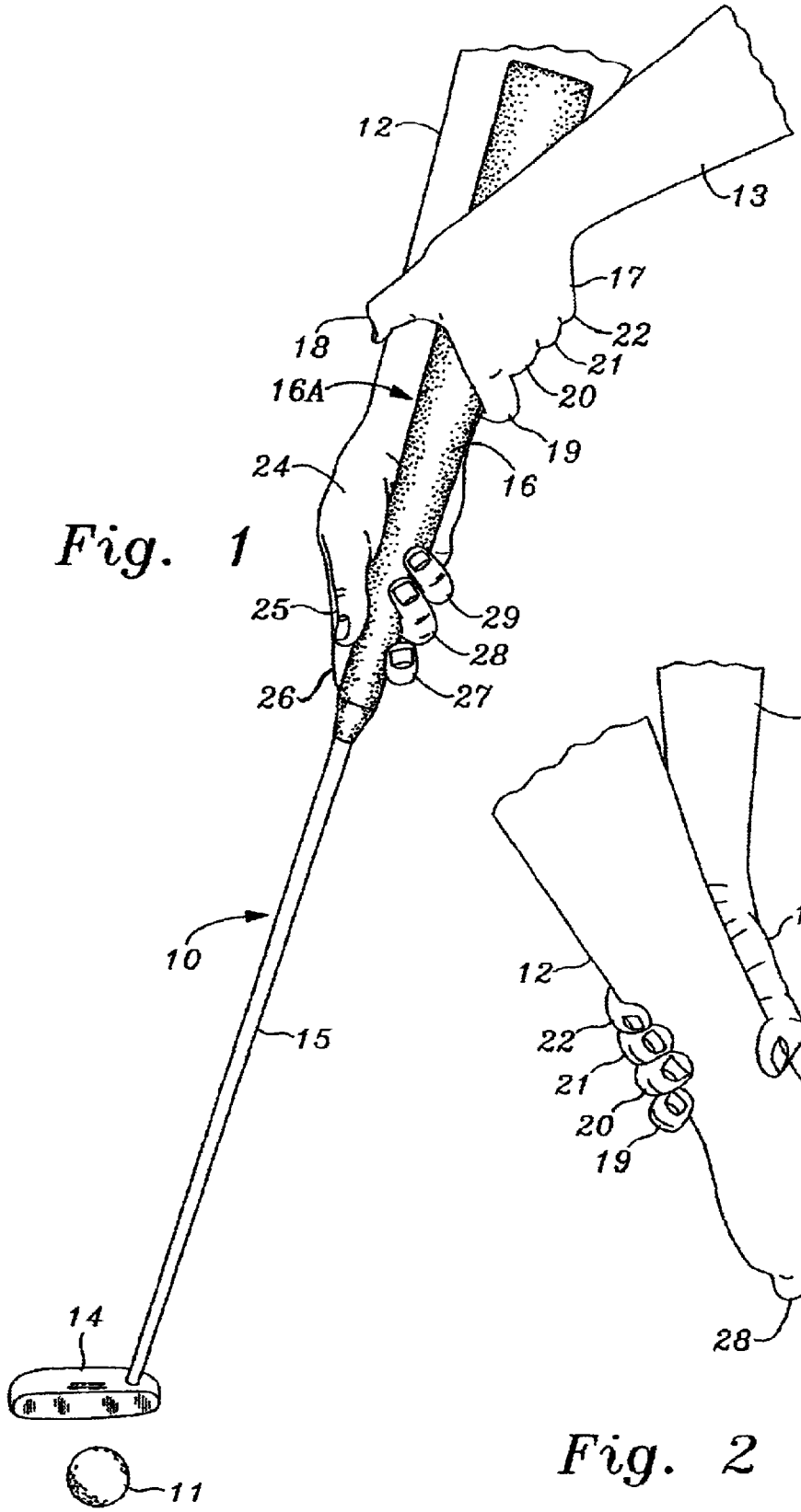
FIG. 1 is a perspective view of a golf club constructed in accordance with the present invention being held by a golf player in a position to strike a golf ball.

Referring to FIG. 1, there is shown a perspective view of a golf club 10 constructed in accordance with a representative embodiment of the present invention. In FIG. 1, golf club 10 is shown as being held by a right-handed golf player in a position to strike a golf ball 11. The golf player's right forearm is identified by reference numeral 12, while the lower part of his left arm is identified by reference numeral 13. As will be discussed later, the construction of the golf club can be easily modified to accommodate a left-handed player. As used herein, the term "dominant hand" means the right hand of a right-handed player and the left hand of a left-handed player. In a similar manner, the term "dominant forearm" refers to the right forearm of a right-handed player and the left forearm of a left-handed player.

The golf club 10 includes a club head 14 for striking or hitting the golf ball 11. Golf club 10 further includes a golf club shaft 15 attached to the club head 14 and extending upwardly therefrom. Golf club 10 also includes a grip assembly 16A having an elongated forearm stabilizer blade 16 attached directly to the upper end of the golf club shaft 15 and extending upwardly in line with the golf club shaft 15. In use, stabilizer blade 16 is pressed snugly against the right forearm 12 by the left hand 17 of the golf player. In particular, the left thumb 18 is placed over the right forearm 12 and left fingers 19–22 are placed under the right forearm 12. The grip of the left hand 17 is tightened so as to press the stabilizer blade 16 firmly against the inner side of the right forearm 12. As shown, stabilizer blade 16 extends a substantial distance up the right forearm 12, nearly to the right elbow of the player.

The right hand 24 of the player is placed on the club 10 in pretty much the normal manner. The right thumb 25 is placed partially over the stabilizer blade 16 with the right index finger 26 placed against the stabilizer blade 16 and extending in a downwardly direction. The remaining right fingers 27–29 are placed under and around the stabilizer blade 16 so as to form a cradle for the stabilizer blade 16.

Figure 2:
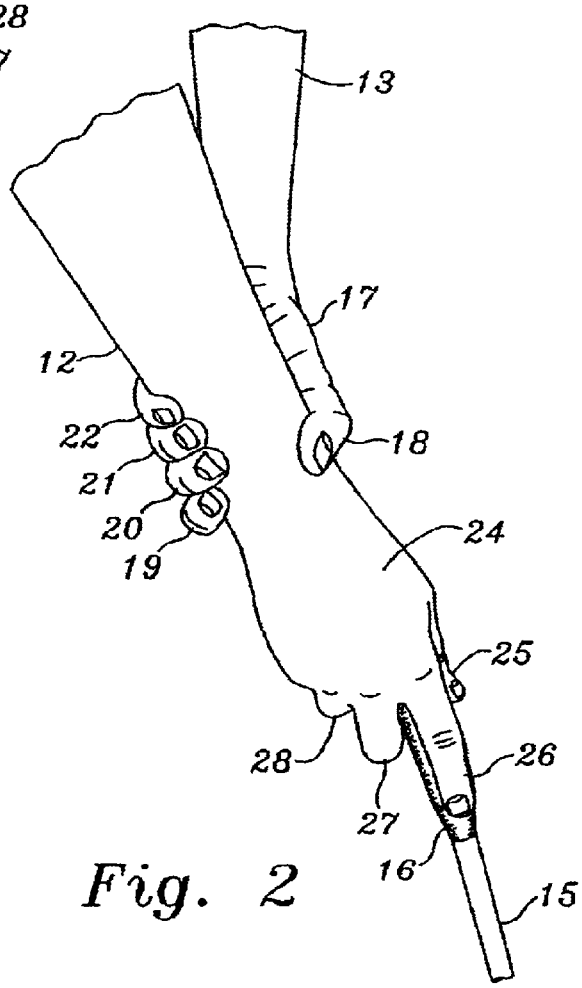
FIG. 2 is a perspective view taken from the side opposite the one shown in FIG. 1.

FIG. 2 is a perspective view of the player's hands 17 and 24 gripping the golf club 10 taken from the side opposite the one shown in FIG. 1. As more clearly seen in FIG. 2, the right index finger 26 of the player rests against and extends along the lower end portion of the stabilizer blade 16. The gripping action of the left hand 17 is clearly visible in FIG. 2.

The golf club 10 with it's upwardly extending stabilizer blade 16 provides the golf player with a steady and consistent pendulum motion when swinging the golf club. The stabilizer blade 16 helps resist any of the twisting, flexing or bending movements of the wrist which so commonly occur with conventional golf club grips.

Figures 3, 4, 5, 6, 7, 8, 9:
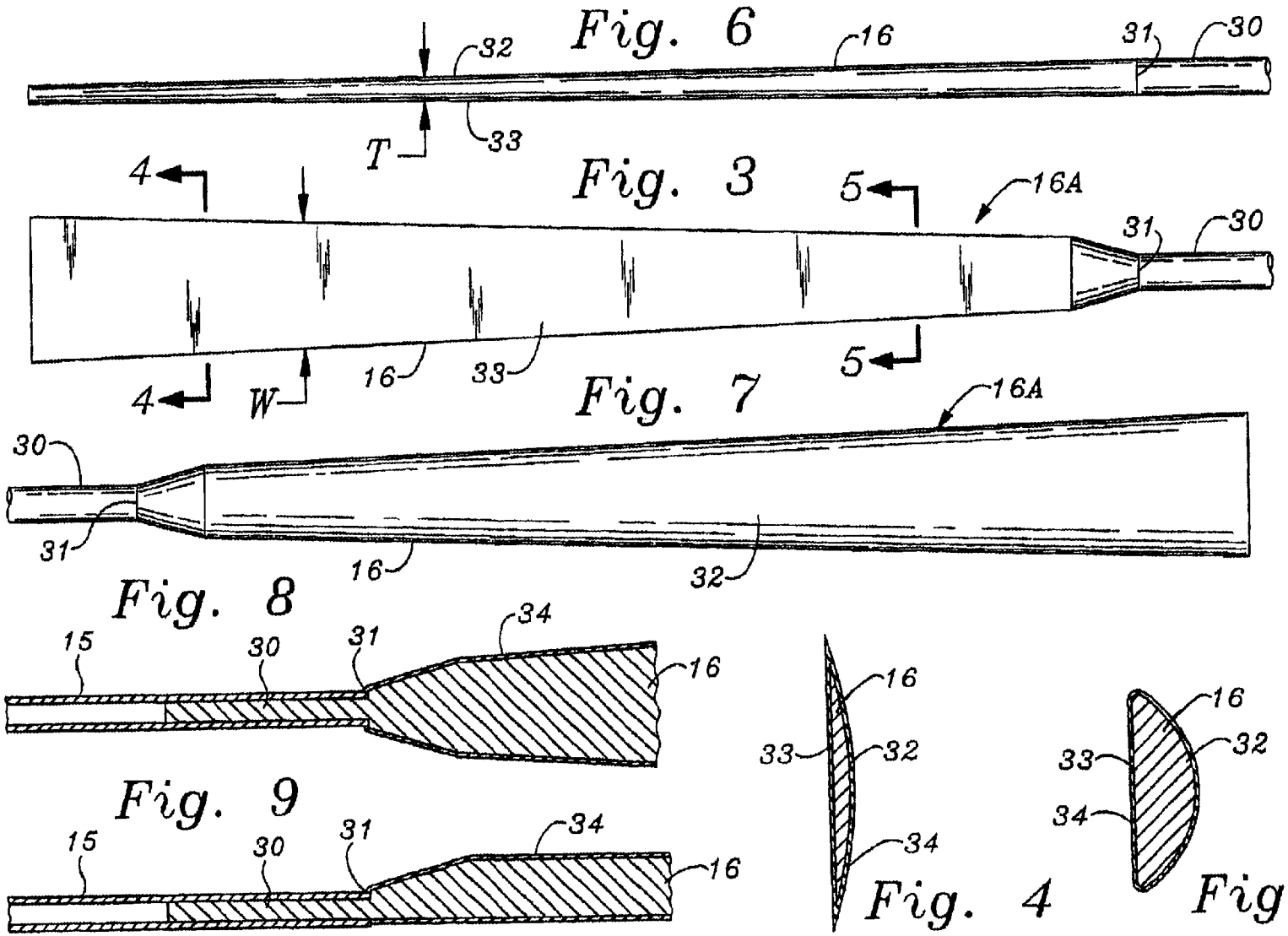
FIG. 3 is a right side view of a representative embodiment of a golf club grip assembly constructed in accordance with the present invention.
FIG. 4 is a cross-sectional view taken along section line 4—4 of FIG. 3.
FIG. 5 is a cross-sectional view taken along section line 5—5 of FIG. 3.
FIG. 6 is an edge view of the golf club grip assembly of FIG. 3.
FIG. 7 is a left side view of the golf club grip assembly of FIG. 3.
FIG. 8 is a cross-sectional view of the golf club shaft end of the golf club assembly of FIG. 7, such cross-sectional view being taken along the longitudinal center axis of FIG. 7 in a plane parallel to the plane of the paper.
FIG. 9 is a cross-sectional view of the golf club shaft end of the golf club assembly of FIG. 7 taken along the longitudinal center axis of FIG. 7 in a plane at right angles to the plane of the paper.

Referring to FIGS. 3–9, there is shown in greater detail the construction of the golf club grip assembly 16A of FIG. 1. FIG. 3 shows a right side view and FIG. 7 shows a left side view of the grip assembly 16A. FIG. 6 is an edge view of grip assembly 16A and FIGS. 4, 5, 8 and 9 are various cross-sectional views.

The grip assembly 16A includes two primary portions. It includes the elongated forearm stabilizer blade 16 for mounting directly on an upper end of a golf club shaft 15 in line with such golf club shaft 15. Grip assembly 16A further includes a connector rod 30 formed integrally with the stabilizer blade 16 and extending from the golf club shaft end 31 of the stabilizer blade 16 for insertion into the upper end of the golf club shaft 15. The cross-sectional views of FIGS. 8 and 9 show the connector rod 30 inserted into the upper end of golf club shaft 15. The fit is a very tight one so that the stabilizer blade 16 cannot rotate with respect to or separate from the golf club shaft 15 during use. If need be, an adhesive material can be applied to the connector rod 30 to insure that connector rod 30 is tightly secured to the inner wall of the golf club shaft 15 after it is inserted therein.

As indicated in the cross-sectional views of FIGS. 4 and 5, the stabilizer blade 16 has a partially-curved cross-sectional shape. In particular, one side 32 of blade 16 is outwardly curved, while the other side 33 is flat. As indicated in the edge view of FIG. 6, the stabilizer blade 16 has a longitudinal taper such that the thickness T of blade 16 decreases with increasing distance from the golf club shaft end 31 of the stabilizer blade 16. As indicated in the side view of FIG. 3, the stabilizer blade 16 has a width W which increases gradually with increasing distance from the golf club shaft end 31 of stabilizer blade 16. Stabilizer blade 16 may have a length of, for example, approximately fourteen to fifteen inches.

Stabilizer blade 16 and connector rod 30 are composed of a strong, rigid material such as, for example, aluminum. These members may be molded as a single solid piece of aluminum and machined, as necessary, to obtain the desired final appearance. As a further option, the stabilizer blade 16 may be coated with a layer of hand gripping material such as, for example, a rubber or leather-like plastic material. This is to improve the gripping action for the player's hand. A representative layer of gripping material is identified by reference numeral 34 in FIGS. 4, 5, 8 and 9. Alternatively, stabilizer blade 16 may be wrapped with a layer of hand grip material, pretty much in the same manner as for a normal golf club handle.

Figure 10:
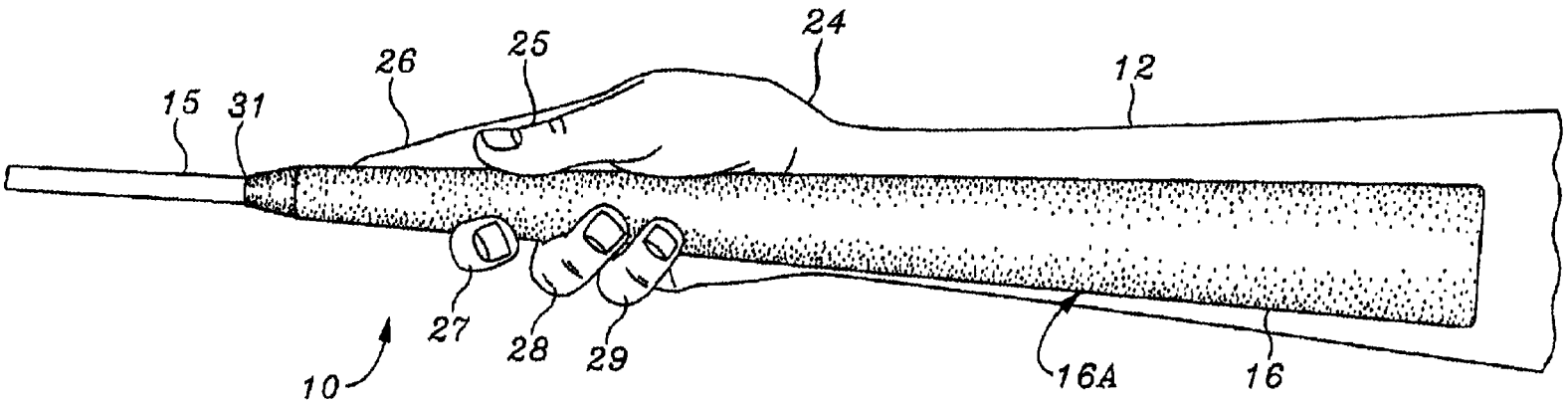
FIG. 10 is a left side perspective view showing the gripping of the golf club grip assembly of FIG. 7 by the right hand of a golf player.

FIG. 10 is a left side perspective view showing the gripping of the golf club grip assembly 16A by the right hand 24 of a right-handed golf player when he is in the process of hitting a golf ball. The flat side of the stabilizer blade 16 is placed along and pressed against the inner side of the right forearm 12 of the golf player. The stabilizer blade 16 has a length sufficient to extend a substantial distance up the forearm 12 of the golf player.

Figure 11:
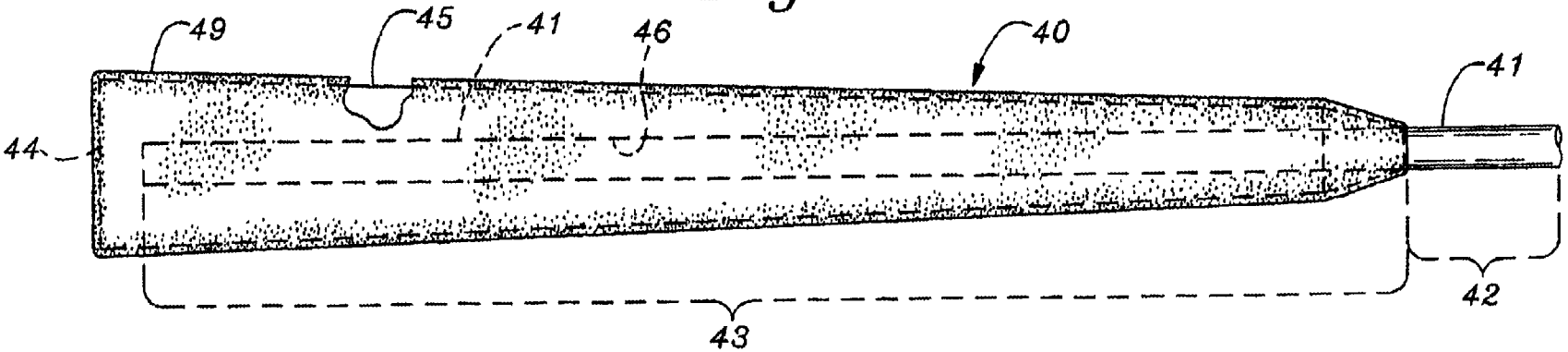
FIG. 11 shows another embodiment of a golf club grip assembly constructed in accordance with the present invention.

Referring now to FIG. 11, there is shown another embodiment of a golf club grip assembly constructed in accordance with the present invention. The grip assembly 40 of FIG. 11 includes an elongated rod 41 having first and second longitudinal sections 42 and 43, respectively. The first section 42 is of shorter length and is adapted for insertion into an upper end of a golf club shaft. The elongated rod 41 may be, for example, a straight, cylindrical rod which extends nearly to the end 44 of the stabilizer blade farthest removed from the golf club shaft.

Grip assembly 40 further includes an elongated forearm stabilizer blade 45 which is mounted on the second section 43 of the elongated rod 41 so as to extend upwardly from and in line with the golf club shaft when the golf club is being used. This stabilizer blade 45 is fabricated separately from the elongated rod 41 and is subsequently mounted on the second section 43 of the elongated rod 41 so as to encircle the second section 43 and to extend the length of the second section 43. In particular, stabilizer blade 45 may be provided with a longitudinal center passageway 46 for receiving and holding the second section 43 of the elongated rod 41. In other words, stabilizer blade 45 is fabricated as a sheath which may be slipped over the second or rearward section of the elongated rod 41. Stabilizer blade 45 is composed of a strong, rigid material such as, for example, metal or hard plastic material. Stabilizer blade 45 may be coated or covered with a layer of hand grip material 49.

As a further embodiment of a golf club grip assembly constructed in accordance with the present invention, the elongated rod 41 of FIG. 11 may be omitted and the central passageway 46 in the stabilizer blade 45 sized to slip over the upper end of the golf club shaft 15. In other words, the stabilizer blade is provided with a longitudinal center passageway and the upper end of the golf club shaft is inserted into this central passageway for purposes of connecting the stabilizer blade to the golf club shaft. The stabilizer blade may be composed of, for example, metal material, rigid plastic material or rigid rubber material.

While described for the case of a right-handed golf player, the grip assembly of the present invention is readily adapted for use by a left-handed golf player. Two things must be taken into consideration to accomplish this purpose. First, a left-handed golf club must be used. Second, the forearm stabilizer blade must be orientated so that it's flat side faces the inside of the left forearm of the player when it is inserted into the upper end of the golf club shaft.

A grip assembly constructed in accordance with the present invention enables a golf player to perform consistently a straight, sweeping follow-through motion when contacting a golf ball. Such a grip assembly provides a steady pendulum effect for straighter hits and increased accuracy. It also helps resist any twisting, flexing or bending movements of the wrist, as is so common with conventional golf club shaft grips. The flat stabilizer blade which rests against the inner side of the player's dominant forearm acts as a support to maintain the pendulum motion, while resisting any flexing of the player's wrist, when held firmly in place by the opposite hand. While particularly well suited for putters, the novel grip assembly described herein can be applied to any golf club shaft with any type of golf club head for improving shot making accuracy and consistency.

While there have been described what are at present considered to be preferred embodiments of this invention, it will be obvious to those skilled in the art that various changes and modifications may be made therein without departing from the invention and it is, therefore, intended to cover all such changes and modifications as come within the true spirit and scope of the invention.

What is claimed is:

1. A golf club comprising:

a club head for striking a golf ball;

a golf club shaft attached to the club head and extending upwardly therefrom;

and a forearm stabilizer blade attached directly to the upper end of the golf club shaft and extending upwardly in line with the golf club shaft for engaging the forearm of a golf player, such stabilizer blade being outwardly curved on one side and flat on the other side, such stabilizer blade being attached to the golf club shaft with the flat side facing away from the rear side of the club head and aligned parallel to the face of the club head and such stabilizer blade having a longitudinal taper such that the thickness of the blade decreases with increasing distance from the golf club shaft end of the stabilizer blade, such thickness being the smallest of three dimensions of length, width and thickness.

2. A golf club in accordance with claim 1 wherein the stabilizer blade has a length sufficient to extend a substantial distance up the forearm of a golf player using the golf club.

3. A golf club in accordance with claim 1 wherein the stabilizer blade has a length of approximately fourteen to fifteen inches.

4. A golf club in accordance with claim 1 wherein the stabilizer blade has a width which increases gradually with increasing distance from the golf club shaft end of the stabilizer blade.

5. A golf club in accordance with claim 1 wherein the stabilizer blade has a connector rod extending from the golf club shaft end of the stabilizer blade, such connector rod being inserted into the upper end of the golf club shaft.

6. A golf club in accordance with claim 1 wherein the stabilizer blade has a longitudinal center passageway, the upper end of the golf club shaft being inserted into this passageway for connecting the stabilizer blade to the golf club shaft.

7. A golf club comprising:

a club head for striking a golf ball;

a golf club shaft attached to the club head and extending upwardly therefrom;

and a forearm stabilizer blade attached directly to the upper end of the golf club shaft and extending upwardly in line with the golf club shaft, such stabilizer blade having a longitudinal taper such that the thickness of the blade decreases with increasing distance from the golf club shaft end of the stabilizer blade, such thickness being the smallest of three dimensions of length, width and thickness.

8. A golf club comprising:

a club head for striking a golf ball;

a golf club shaft attached to the club head and extending upwardly therefrom;

and a forearm stabilizer blade attached directly to the upper end of the golf club shaft and extending upwardly in line with the golf club shaft, wherein the stabilizer blade:

is composed of a strong, rigid material;

has a length of approximately fourteen to fifteen inches;

is outwardly curved on one side and is flat on the other side;

has a longitudinal taper such that the thickness of the stabilizer blade decreases with increasing distance from the golf club shaft end of the stabilizer blade;

has a width which increases gradually with increasing distance from the golf club shaft end of the stabilizer blade;

and has a connector rod extending from the golf club shaft end of the stabilizer blade, such connector rod being inserted into the upper end of the golf club shaft.

9. A golf club grip assembly comprising:

an elongated forearm stabilizer blade for mounting directly on an upper end of a golf club shaft in line with the golf club shaft for extending upwardly in line with the golf club shaft for engaging the forearm of a golf player, such stabilizer blade being outwardly curved on one side and flat on the other side and having a longitudinal taper such that the thickness of the blade decreases with increasing distance from the golf club shaft end of the stabilizer blade, such thickness being the smallest of three dimensions of length, width and thickness;

and a connector rod formed integrally with the stabilizer blade and extending from the golf club shaft end of the stabilizer blade for insertion into the upper end of the golf club shaft with the flat side of the stabilizer blade facing away from the rear side of the club head and aligned parallel to the face of the club head.

10. A golf club grip assembly in accordance with claim 9 wherein the elongated stabilizer blade has a width which increases gradually with increasing distance from the golf club shaft end of the stabilizer blade.

11. A golf club grip assembly comprising:

an elongated forearm stabilizer blade for mounting directly on an upper end of a golf club shaft in line with the golf club shaft;

and a connector rod formed integrally with the stabilizer blade and extending from the golf club shaft end of the stabilizer blade for insertion into the upper end of the golf club shaft;

wherein the elongated stabilizer blade has a longitudinal taper such that the thickness of the blade decreases with increasing distance from the golf club shaft end of the stabilizer blade, such thickness being the smallest of three dimensions of length, width and thickness.

* * * * *